US009215901B1

(12) United States Patent
Schroeder

(10) Patent No.: US 9,215,901 B1
(45) Date of Patent: Dec. 22, 2015

(54) EYELASH APPLICATION SYSTEM

(71) Applicant: Sandi Schroeder, Los Angeles, CA (US)

(72) Inventor: Sandi Schroeder, Los Angeles, CA (US)

( * ) Notice: Subject to any disclaimer, the term of this patent is extended or adjusted under 35 U.S.C. 154(b) by 0 days.

(21) Appl. No.: 14/476,746

(22) Filed: Sep. 4, 2014

(51) Int. Cl.

| | |
|---|---|
| ***A41G 3/00*** | (2006.01) |
| ***A41G 5/00*** | (2006.01) |
| ***A45D 40/30*** | (2006.01) |
| ***A41G 5/02*** | (2006.01) |

(52) U.S. Cl.
CPC ..... *A41G 5/02* (2013.01)

(58) Field of Classification Search
CPC ..... A41G 5/00; A41G 5/0013; A41G 5/0033; A41G 5/004; A41G 5/0053; A41G 5/008; A41G 5/0086; A41G 5/02; B54D 1/34; B65D 73/00; B65D 85/00; A45D 44/00; A45D 40/30; A61F 2/10; A61M 35/003
USPC ..... 132/201, 212, 216, 217, 218, 53, 54, 132/317, 320; 206/460, 557, 562, 563, 564, 206/565, 581, 823; 623/15.11; 446/389, 446/393; D28/36, 39, 55, 92, 93; 401/9–11
See application file for complete search history.

(56) References Cited

U.S. PATENT DOCUMENTS

| | | | | | |
|---|---|---|---|---|---|
| 1,666,116 | A | * | 4/1928 | Bunnell | 401/10 |
| 1,810,566 | A | * | 6/1931 | Keney | 446/394 |
| 1,960,687 | A | * | 5/1934 | Wills | 606/205 |
| 2,079,256 | A | * | 5/1937 | Kaiser | 132/53 |
| 2,094,409 | A | * | 9/1937 | Phillips, Sr. | 132/53 |
| 2,268,082 | A | * | 12/1941 | Phillips, Sr. | 132/53 |
| 3,333,593 | A | | 8/1967 | McGivern | |
| 3,478,754 | A | * | 11/1969 | Martin, Jr. | 132/216 |
| 3,511,248 | A | * | 5/1970 | Panda | 132/216 |
| 3,625,229 | A | * | 12/1971 | Silson | 132/216 |
| 3,828,803 | A | | 8/1974 | Windsor | |
| 3,935,872 | A | | 2/1976 | Aylott | |
| 4,018,336 | A | * | 4/1977 | Aylott | 206/460 |
| 6,029,674 | A | | 2/2000 | Han | |
| 6,105,585 | A | * | 8/2000 | Thomas | 132/217 |
| 6,789,551 | B2 | * | 9/2004 | Iosilevich | 132/217 |
| 8,015,980 | B2 | | 9/2011 | Rabe et al. | |
| 8,127,776 | B2 | * | 3/2012 | Green | 132/216 |
| D669,223 | S | | 10/2012 | Lee et al. | |
| 8,424,542 | B1 | | 4/2013 | Han | |
| 8,616,223 | B2 | | 12/2013 | Rabe et al. | |
| 8,864,398 | B2 | * | 10/2014 | McNamara et al. | 401/130 |
| 2003/0005941 | A1 | * | 1/2003 | Iosilevich | 132/53 |
| 2009/0217938 | A1 | * | 9/2009 | Rabe et al. | 132/216 |
| 2010/0043816 | A1 | | 2/2010 | Dix | |
| 2011/0079236 | A1 | * | 4/2011 | Lee et al. | 132/201 |
| 2011/0232666 | A1 | * | 9/2011 | Liao | 132/201 |
| 2012/0000957 | A1 | | 1/2012 | Martinez | |
| 2013/0042884 | A1 | | 2/2013 | Wilkinson | |
| 2013/0133681 | A1 | | 5/2013 | Chipman | |
| 2013/0160787 | A1 | | 6/2013 | Chae et al. | |
| 2015/0075549 | A1 | * | 3/2015 | Lee et al. | 132/53 |
| 2015/0201692 | A1 | * | 7/2015 | Hansen et al. | 132/201 |

* cited by examiner

*Primary Examiner* — Vanitha Elgart
(74) *Attorney, Agent, or Firm* — John D. Tran; Rhema Law Group

(57) ABSTRACT

A method and apparatus of an eyelash application system can include: a cartridge having a handle, a seat, and a cartridge mating structure; an eyelash strip attached to the seat of the cartridge; and an applicator having a top arm with a clamping pad, the clamping pad including an applicator mating structure configured to interlock with the cartridge mating structure.

19 Claims, 5 Drawing Sheets

EYELASH APPLICATION SYSTEM

TECHNICAL FIELD

This disclosure relates to systems and methods for personal care, more partially for handling, storing, and applying false eyelashes.

BACKGROUND

People around the world use products to enhance their appearance. All forms of cosmetics are used in the fashion, medical, and entertainment industries. False eyelashes and eyelash extensions are a commonly used technique for enhancing or augmenting the appearance of the eye.

Current methods for applying, storing, and handling false eyelashes present many problems that range from deleterious health consequences to difficulty in handling requiring a high degree of skill. Health consequences can result from the false eyelashes coming into contact with bacteria or other contagion eventually infecting the eye. This can happen when tools are improperly used or sanitized. This can also happen when an adhesive is applied in an unsanitary way.

Difficulty in applying false eyelashes can result from the awkward use of a delicate tweezer or even from attempting to apply the false eyelash with the naked finger tips. It is common for the false eyelash to be applied further from the base of the real eyelash than desirable, or with too much glue or adhesive.

Solutions have been long sought but prior developments have not taught or suggested any solutions that provide a comprehensive answer to these difficulties, and solutions to these problems have long eluded those skilled in the art. Thus there remains a considerable need for devices and methods that allow the application of false eyelashes in an easy intuitive way with minimal expertise or experience.

SUMMARY

Contemplated embodiments of the eyelash application system can include devices and methods having a cartridge having a handle, a seat, and a cartridge mating structure; an eyelash strip attached to the seat of the cartridge; and an applicator having a top arm with a clamping pad, the clamping pad including an applicator mating structure configured to interlock with the cartridge mating structure.

Accordingly it has been discovered that one or more embodiments described herein can provide a natural intuitive solution allowing users to apply eyelash strips with minimal experience and minimal ability. Accordingly many embodiments have been discovered to be useful in the health industry for allowing patients undergoing treatment, such as chemo therapy, to apply the eyelash strips even when they have never needed to before.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The eyelash application system is illustrated in the figures of the accompanying drawings which are meant to be exemplary and not limiting, in which like reference numerals are intended to refer to like components, and in which.

DETAILED DESCRIPTION

Figure 1:
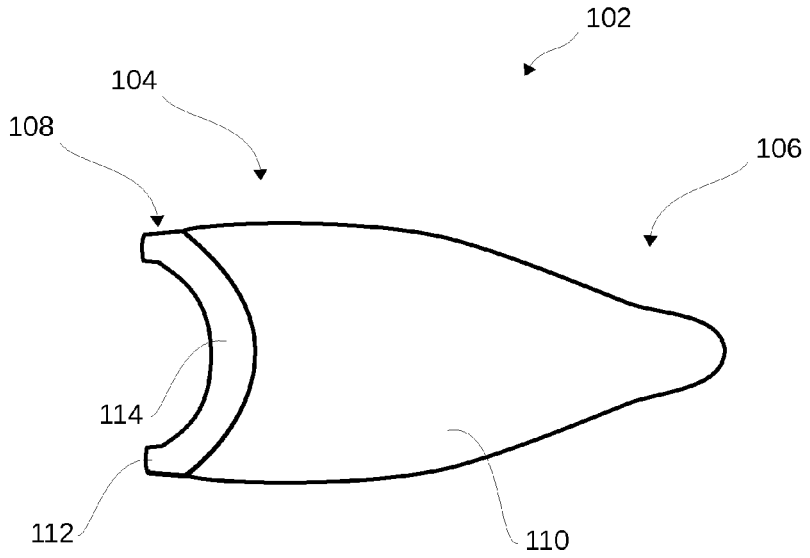
FIG. 1 is a top view of an applicator for an embodiment of the eyelash application system.

In the following description, reference is made to the accompanying drawings that form a part hereof, and in which are shown by way of illustration, embodiments in which the eyelash application system may be practiced. It is to be understood that other embodiments may be utilized and structural changes may be made without departing from the scope of the eyelash application system.

The eyelash application system is described in sufficient detail to enable those skilled in the art to make and use the eyelash application system and provide numerous specific details to give a thorough understanding of the eyelash application system; however, it will be apparent that the eyelash application system may be practiced without these specific details.

In order to avoid obscuring the eyelash application system, some well-known system configurations are not disclosed in detail. Likewise, the drawings showing embodiments of the system are semi-diagrammatic and not to scale and, particularly, some of the dimensions are for the clarity of presentation and are shown greatly exaggerated in the drawing FIGS. Generally, the eyelash application system can be operated in any orientation.

For expository purposes, the term "horizontal" as used herein is defined as a plane parallel to the bottom plane or bottom surface of the cartridge, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane. The term "system" means an apparatus or a method based on the context in which it is used.

Referring now to FIG. 1, therein is shown a top view of an applicator 102 for an embodiment of the eyelash application system. The applicator 102 is shown having a broad distal end 104 and a narrow proximal end 106. The distal end 104 includes a clamping pad 108, curved with a concave curve, to match the shape of a users eye and the eyelash strips (shown and described below).

It has been discovered that providing the distal end having a large width and surface to handle reduces the skill requirement for use. The large width and surface allows the applicator 102 to be used by users with a lesser dexterity and allows users to fix multiple fingers along with the thumb on the applicator 102 during used and utilize the larger muscles of the arm and wrist allowing for greater controllability and stability which can result in safer and more precise operation.

The proximal end 106 is the end that is closer to a users wrist during operation while the distal end 104 is the end that is closer to a users eye during operation. The proximal end 106 can be formed with a smaller cross-section than the distal end 104 for greater mobility in the hand so that the distal end 104 can be held in a number of different positions within the hand.

The clamping pad 108 on the distal end 104 of the applicator 102 can be made of a soft or pliable material such as silicon or rubber. The clamping pad 108 can be attached to a ridged member 110. The ridged member 110 spans the applicator 102 from the proximal end 106 to the distal end 104.

It is contemplated that the ridged member 110 can be formed within the clamping pad 108 to provide structural rigidity for the clamping pad 108. It is further contemplated that the ridged member 110 can be formed within the center of the clamping pad 108 while leaving the outer edges of the clamping pad 108 un-reinforced by the ridged member 110 so that the center of the clamping pad 108 can have a different amount of structural rigidity than the outer edges.

The clamping pad 108 can further include side extensions 112 that extend away from the ridged member 110 and the proximal end 106. The side extensions 112 can border a concave portion 114 of the clamping pad 108.

Figure 2:
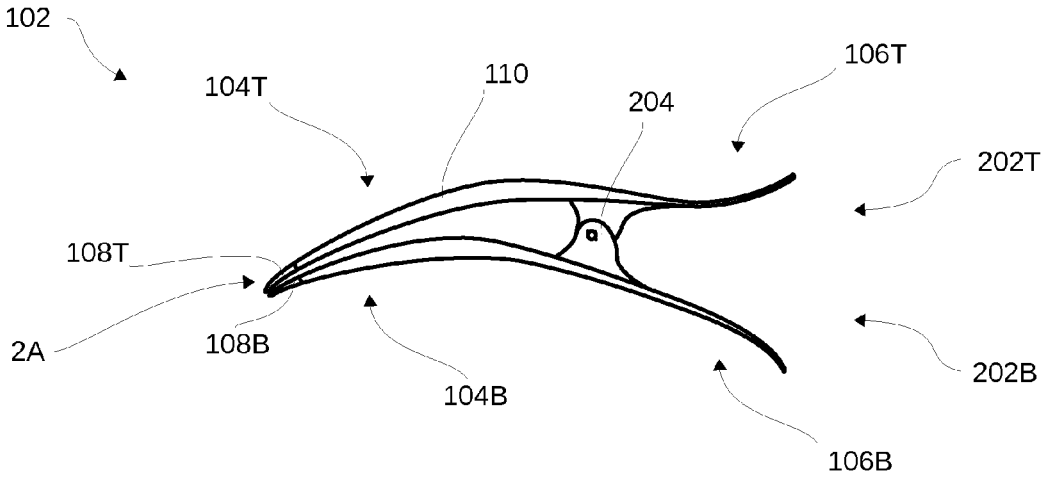
FIG. 2 is a side view of the applicator of FIG. 1.

Referring now to FIG. 2, therein is shown a side view of the applicator 102 of FIG. 1. For clarity when referring to the applicator 102 the reference suffix letters "T" and "B" will be appended to the reference numerals where needed to refer to elements of a top arm 202T and bottom arm 202B, respectively. The top arm 202T and the bottom arm 202B are both shown having a clamping pad 108T and clamping pad 108B, a distal end 104T and distal end 104B, a proximal end 106T and proximal end 106B, respectively.

The distal end 104T of the top arm 202T and the distal end 104B of the bottom arm 202B are shown converging toward each other and having the clamping pad 108T of the top arm 202T and the clamping pad 108B of the bottom arm 202B in direct contact. In this position the applicator 102 is in a closed position.

The applicator 102 can be opened by pressing the proximal end 106T and the proximal end 106B toward each other. The top arm 202T and the bottom arm 202B are connected with a hinge 204.

The hinge 204 can provide a fulcrum to allow the top arm 202T and the bottom arm 202B to pivot open and closed. A spring (not shown) can be used to maintain a closing force to keep the applicator 102 in the closed position. The force of the spring may be overcome by a user's application of a pinching force on the proximal end 106T and the proximal end 106B.

The distal end 104T and the distal end 104B are depicted with a downward curve while the proximal end 106T is depicted as curving up away from the distal end 104B. The proximal end 106B is depicted with a downward curve away from the proximal end 106T. Further the distal end 104T of the top arm 202T and the distal end 104B of the bottom arm 202B are shown having a thick cross-section that narrows toward the ends.

It has been discovered that the downward curve of the distal end 104T of the top arm 202T and the distal end 104B of the bottom arm 202B decrease the amount of skill required to use the applicator 102 by providing a natural intuitive shape that can be easily held and maneuvered in the hand. It has been discovered that the direction and shape of the curve of the distal end 104T and the distal end 104B help to provide an intuitive positioning of the applicator 102 near a user's eyelid when in use.

It has been further discovered that providing the proximal end 106T of the top arm 202T that curves away from the proximal end 106B of the bottom arm 202B also provides for better usability because the distal end 104T and the distal end 104B can be held with multiple finger tips of a user along with a thumb while the proximal end 106T can be anchored into the palm of a user allowing the distal end 104T and distal end 104B to be pinched solidly together by the user to provide added control and force when needed.

The clamping pad 108T and the clamping pad 108B are depicted converging in a narrow wedge. The convergence of the clamping pad 108T and the clamping pad 108B provide a fine maneuverable edge that facilitates the application of the eyelash strips of FIG. 3 with exacting detail near the base of the eyelash line of a user's eyelash.

The fine tip of the clamping pad 108T and the clamping pad 108B depicted in the side view of the present FIG. is contrasted by the large width of the distal end 104 depicted in the top view of FIG. 1. For maximum articulation and control the width of the distal end 104 shown from the top in FIG. 1 can be five times to eight times wider than a combination of the thickness of the clamping pad 108T and the clamping pad 108B measured from the roots of the clamping pad 108T and the clamping pad 108B near the ridged member 110. Further the width of the distal end 104 shown from the top in FIG. 1 can be the same as the length of the distal end 104T or the distal end 104B measured from the hinge 204 to their respective clamping pad 108, that is the clamping pad 108T or the clamping pad 108B.

Figure 3:
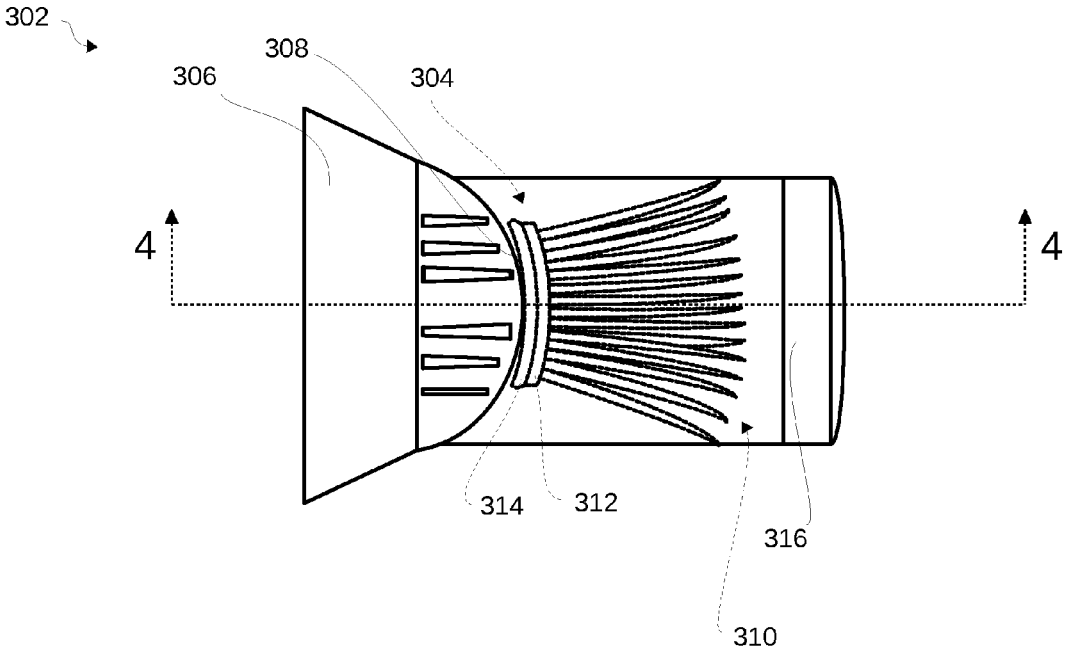
FIG. 3 is a top view of a cartridge for an embodiment of the eyelash application system.

It has been discovered that the combination of distal end 104 having a large width shown in FIG. 1 in relation to the thickness of the clamping pad 108T and the clamping pad 108B shown in FIG. 2 greatly enhances the maneuverability and stability in the hand of a user reducing the skill required to apply the eyelash strips of FIG. 3 since the entire ridged members 110 of the top arm 202T and the bottom arm 202B is configured to be gripped comfortably as a handle. Because the expertise required to use the applicator 102 is greatly decreased, many people with little to no experience, including those with health issues that may need false eyelashes for the first time, are enabled with the eyelash application system.

Figure 2A:
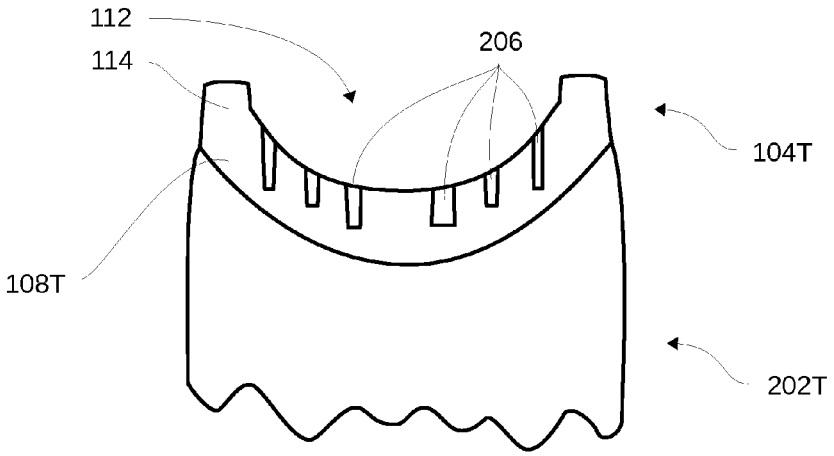
FIG. 2A is a bottom view of the distal end of the top arm from area 2A of FIG. 2.

Referring now to FIG. 2A, therein is shown a bottom view of the distal end 104T of the top arm 202T from area 2A of FIG. 2. The clamping pad 108T is depicted having applicator mating structures 206.

The applicator mating structures 206 can be recesses, a protrusion, or a combination thereof. The applicator mating structures 206 can be configured to join or fit together with cartridge mating structures described below with regard to FIG. 3. The applicator mating structures 206 are depicted along the concave portion 114 and between the side extensions 112 of the clamping pad 108. It is contemplated that the mating structures of the clamping pad 108T and the applicator mating structures 206 of the clamping pad 108B would be configured to be non-complementary so that when the top arm 202T of FIG. 2 and the bottom arm 202B of FIG. 2 are in direct contact, the clamping pad 108B and the clamping pad 108T will not interlock or join together by interlocking the applicator mating structures 206 on the clamping pad 108T and the clamping pad 108B.

Referring now to FIG. 3, therein is shown a top view of a cartridge 302 for an embodiment of the eyelash application system. The cartridge 302 is shown loaded with an eyelash strip 304.

The cartridge 302 can include a handle 306 that narrows to a seat 308. The handle 306 can widen near an end so that a user may grasp the cartridge 302 with ease.

The seat 308 of the cartridge 302 provides a platform for the eyelash strip 304 to be mounted and stored. The seat 308 can be curved with a smaller diameter than the eyelash strip 304 allowing the eyelash strip 304 to overhang the seat 308.

The eyelash strip 304 can include lashes 310, a band 312, and an adhesive 314. The lashes 310 can be mounted to the band 312 and extend out away from the band 312. The lashes 310 can fan out radially and be curved upward from a plane defined by the band 312.

The band 312 can be in direct contact with the adhesive 314. The adhesive 314 can cover the entire band 312 and extend beyond the ends of the band 312. It has been discovered that it is advantageous to not require a user to manually apply the adhesive 314 because it is easy for a user to apply more than required or to allow the adhesive 314 to contact an unsanitary surface. Providing the adhesive 314 already applied therefore increases uniformity of the adhesive 314 as well as ensuring a non-infectious adhesive 314 is used.

The eyelash strip 304 can be provided within the cartridge 302 as a one quarter, two thirds, or full eyelash strip 304. In some embodiments, it is contemplated that the eyelash strip 304 can be formed as a quarter or two thirds strip negating the need for a user to trim the eyelash strip 304.

Extending from above the eyelash strip 304 is a clip 316. The clip 316 is depicted as narrower than the seat 308 or the handle 306 but larger in width than the eyelash strip 304. The clip 316 can cover and contain the eyelash strip 304 in a sanitary, secure environment until the lash is adhered to a user's eye.

Between the seat 308 and the handle 306, the cartridge 302 is depicted as having cartridge mating structures 318. The cartridge mating structures 318 can be formed as recesses, protrusions, or a combination thereof.

The cartridge mating structures 318 are configured to mirror the applicator mating structures 206 of FIG. 2A and to be joined or fitted to the applicator mating structures 206. That is when one of the applicator mating structures 206 is a protrusion that narrows toward the proximal end 106 of FIG. 1, the corresponding cartridge mating structures 318 will be a recess that also narrows toward the proximal end 106 of the applicator 102 of FIG. 1.

It is contemplated that the cartridge mating structures 318 as well as the applicator mating structures 206 can taper toward or away from the proximal end 106. It is further contemplated that the cartridge mating structures 318 as well as the applicator mating structures 206 can have no taper toward or away from the proximal end 106.

The applicator mating structures 206 are configured to interlock with the cartridge mating structures 318 where both the cartridge mating structures 318 and the applicator mating structures 206 have surfaces that are in continuous direct contact. It is contemplated that the applicator mating structures 206 can deform into or around the cartridge mating structures 318 and provide a click when the applicator mating structures 206 is fully engaged with the cartridge mating structures 318.

Figure 4:
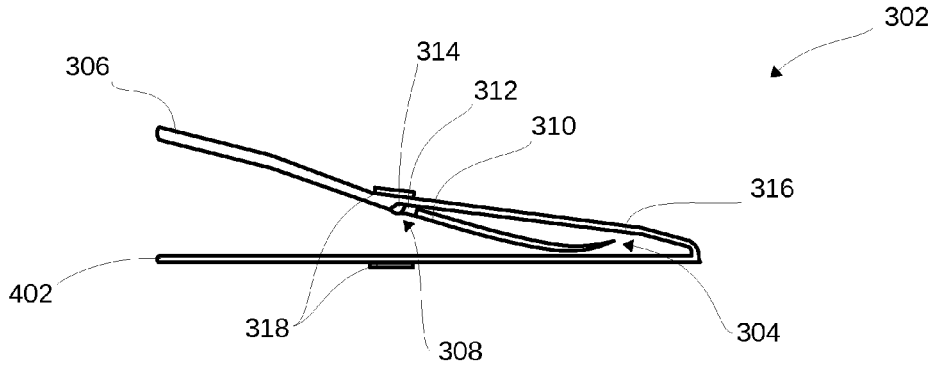
FIG. 4 is a cross-sectional view of the cartridge of FIG. 3 along the line 4-4.

Referring now to FIG. 4, therein is shown a cross-sectional view of the cartridge 302 of FIG. 3 along the line 4-4. The cartridge 302 is shown having the eyelash strip 304 with the lashes 310, the band 312, and the adhesive 314 attached to the seat 308. In one contemplated embodiment the seat 308 is contemplated to be a concave surface between the handle 306 and the clip 316. The seat 308 can provide a backstop for the eyelash strip 304 when the eyelash strip 304 is mounted to the clip 316.

The lashes 310 are shown protected within the clip 316. It has been discovered that the clip 316 can provide a protective area for the lashes 310 providing increased sanitation and simultaneously less damage.

The handle 306 can be grasped alone or in combination with a lower bar 402 extending under the entire handle 306 and clip 316. The lower bar 402 in combination with the clip 316 enable the cartridge 302 to be mounted securely into the case of FIG. 7. The lower bar 402 can also increase the ability of a user to handle the cartridge 302 by allowing the user to grasp both the handle 306 and the lower bar.

The cartridge 302 is further depicted having the cartridge mating structures 318 on both the lower bar 402 and between the handle 306 and the clip 316. The cartridge mating structure is shown from the side including ends that extend toward the cartridge 302 in both right angles as well as obtuse and acute angles.

Figure 5:
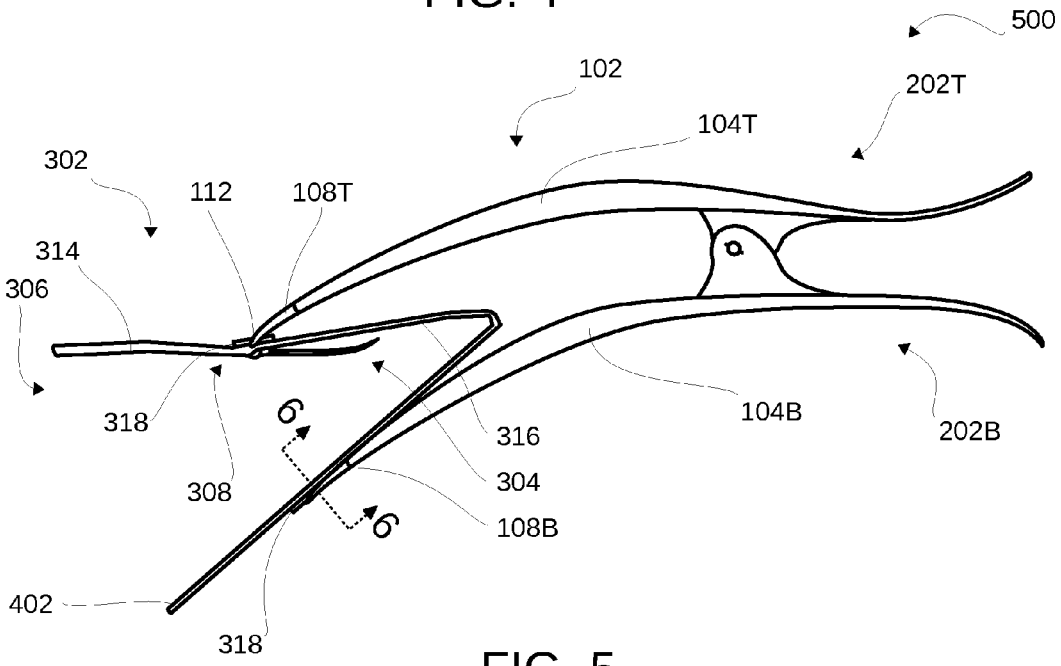
FIG. 5 is a side view of the applicator of FIG. 1 and the cartridge of FIG. 3 after a loading phase of operation.

Referring now to FIG. 5, therein is shown a side view of the eyelash application system 500 after a loading phase of operation. The eyelash application system is depicted with the applicator 102 in an open configuration having the distal end 104T of the top arm 202T and the distal end 104B of the bottom arm 202B spaced apart from each other. The clamping pad 108T is depicted having the side extensions 112 overhanging the cartridge 302.

The cartridge 302 is also shown attached to the clamping pad 108T and the clamping pad 108B and secured thereto by the interlocking of the applicator mating structures 206 of FIG. 2 with the cartridge mating structures 318. The cartridge mating structures 318 joined to or interlocked with the applicator mating structures 206 allow the cartridge 302 to be pulled apart so that the handle 306 is pulled further out away from the lower bar 402 exposing the eyelash strip 304 so that it can be positioned near a user's eyelid. It is contemplated that the adhesive 314 can be designed to interact with less adhesion to the seat 308 than to the eyelid of a user allowing the eyelash strip 304 to detach easily from the seat 308.

Figure 6:
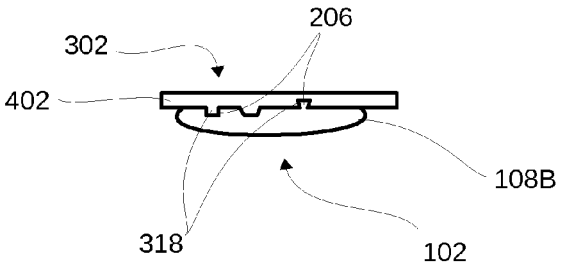
FIG. 6 is a cross-sectional view of the cartridge and applicator of FIG. 5 along the line 6-6.

Referring now to FIG. 6, therein is shown a cross-sectional view of the cartridge 302 and applicator 102 of FIG. 5 along the line 6-6. The lower bar 402 of the cartridge 302 is shown having the cartridge mating structures 318 interlocked with the applicator mating structures 206 on the clamping pad 108B of the applicator 102.

The cartridge mating structures 318 are shown extending away from the cartridge 302 as well as into the cartridge 302 at right angles, obtuse, and acute angles. Likewise, the applicator mating structures 206 are shown extending away from the clamping pad 108B as well as into the clamping pad 108B at right angles, obtuse angles, and acute angles. It has been discovered that utilizing the applicator mating structures 206 interlocking with the cartridge mating structures 318 the eyelash strip 304 of FIG. 5 can be locked in to an exacting position with regard to the applicator 102 and enables users to more quickly and intuitively apply the eyelash strip 304.

Figure 7:
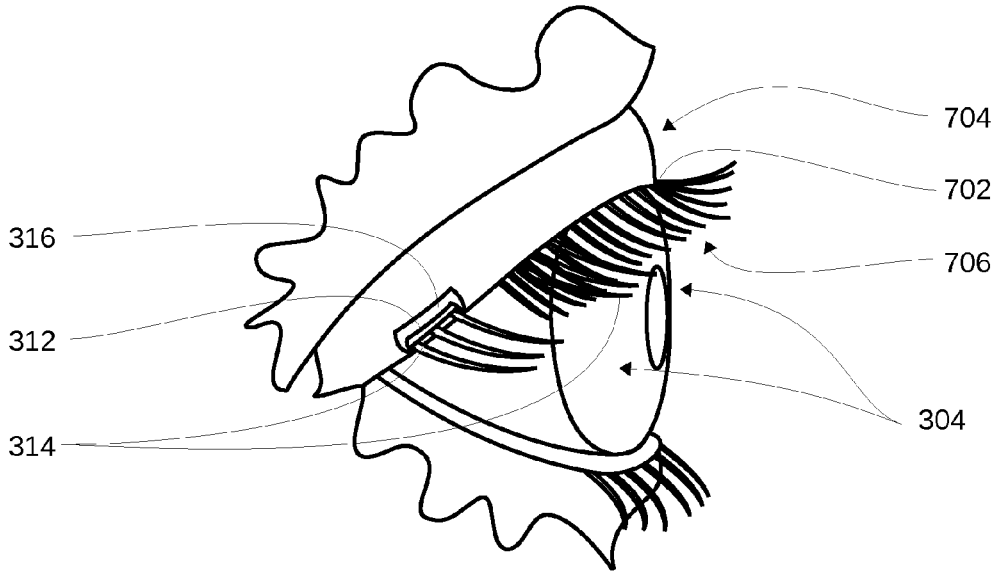
FIG. 7 is an isometric view of the eyelash strip after an attachment phase of operation.

Referring now to FIG. 7, therein is shown an isometric view of the eyelash strip after an attachment phase of operation. The eyelash strip 304 is shown having the adhesive 314 in direct contact with a base 702 of the users eyelid 704. The adhesive 314 directly couples the base 702 with the band 312 holding the lashes 310.

Two ways of applying the eyelash strip 304 are depicted including one method applying the eyelash strip 304 above the eyelash 706 of the user. The other method depicted includes applying the eyelash strip 304 below the eyelash 706 of the user. When the eyelash strip 304 is attached below the eyelash 706 of the user, the band 312 and the adhesive 314 are not visible.

Figure 8:
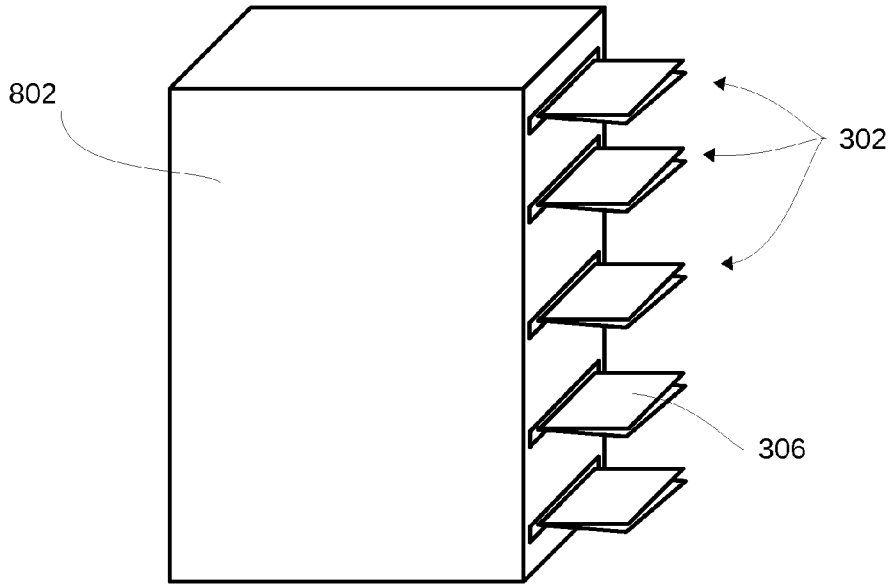
FIG. 8 is an isometric view of a case of the cartridges for an embodiment of the eyelash application system.

Referring now to FIG. 8, therein is shown an isometric view of a case 802 of the cartridges 302 for an embodiment of the eyelash application system 500. The case 802 is shown having multiple cartridges 302 partially contained within the case 802. It is contemplated that the case can fasten releasably to the clip 316 of FIG. 3, to the cartridge mating structures 318 of FIG. 3, or to a combination thereof.

It is further contemplated that the case 802 can provide a sterile environment, an air-tight environment, or a combination thereof for the eyelash strip 304 of FIG. 3 attached to the cartridge 302. It is contemplated the case 802 can provide organization for the cartridge 302 based on the type, length, or color of the lashes 310 of FIG. 3.

The handle 306 of the cartridge 302 is shown protruding from the case 802 allowing a user to grasp the handle 306 and pull the handle 306 of the cartridge 302 away from the case 802 to remove the cartridge 302. It is also contemplated that the handle 306 protruding from the case 802 enables the cartridge 302 to be handled easily even by those with physical disabilities.

Figure 9:
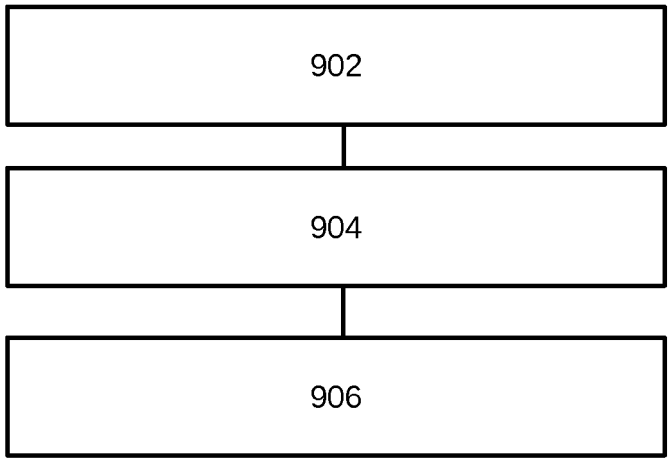
FIG. 9 is a flow chart for a method of operating the eyelash application system.

Referring now to FIG. 9, therein is shown a flow chart for a method of operating the eyelash application system 500 of FIG. 5 including: acquiring a cartridge having a cartridge mating structure and an eyelash strip adhered to the cartridge in a block 902; coupling an applicator to the cartridge by interlocking the cartridge mating structure with an applicator mating structure in a block 906; and attaching the eyelash strip to a user's eyelash base of a user's eyelid in a block 908.

Figure 10:
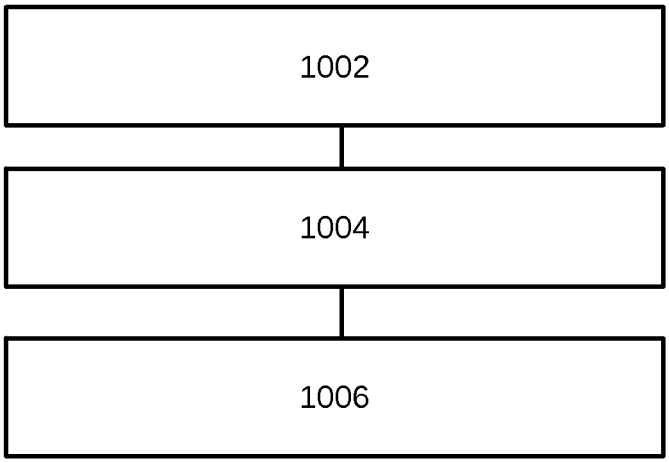
FIG. 10 is a flow chart for a method of manufacturing the eyelash application system.

Referring now to FIG. 10, therein is shown a flow chart for a method of manufacturing the eyelash application system 500 of FIG. 5 including: providing a cartridge having a handle, a seat, and a cartridge mating structure in a block 1002; attaching an eyelash strip to the cartridge in a block 1004; and attaching a clamping pad to a top arm of an applicator, the clamping pad including an applicator mating structure configured to interlock with the cartridge mating structure in a block 1006.

Thus, it has been discovered that the eyelash application system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the eyelash application system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. An eyelash application system comprising:

a cartridge having a handle, a seat, a clip extending from above the seat and the clip is narrower than the handle, and a cartridge mating structure;

an eyelash strip attached to the seat of the cartridge with the clip of the cartridge being wider than the eyelash strip; and an applicator having a top arm with a clamping pad, the clamping pad including an applicator mating structure configured to interlock with the cartridge mating structure.

2. The system of claim 1 wherein the eyelash strip is attached to the seat of the cartridge with an adhesive.

3. The system of claim 1 wherein the clamping pad is made of a pliable material.

4. The system of claim 1 wherein the applicator further includes a bottom arm coupled to the top arm with a hinge and the bottom arm including a second clamping pad configured to contact the clamping pad of the top arm.

5. The system of claim 4 wherein the width of the top arm is more than five times the thickness of the combination of the second clamping pad on the bottom arm and the clamping pad on the top arm.

6. The system of claim 1 wherein the eyelash strip overhangs the seat.

7. The system of claim 1 wherein the eyelash strip includes a lash that curves toward the clip.

8. The system of claim 1 wherein the clamping pad of the top arm includes a concave portion.

9. A method of manufacturing an eyelash application system comprising:

providing a cartridge having a handle, a seat, a clip extending from above the seat and the clip is narrower than the handle, and a cartridge mating structure;

attaching an eyelash strip to the seat of the cartridge with the clip of the cartridge being wider than the eyelash strip; and cartridge; and attaching a clamping pad to a top arm of an applicator, the clamping pad including an applicator mating structure configured to interlock with the cartridge mating structure.

10. The method of claim 9 wherein attaching the clamping pad includes attaching the clamping pad having a concave portion.

11. The method of claim 9 wherein attaching the eyelash strip includes attaching the eyelash strip with an adhesive to the seat of the cartridge.

12. The method of claim 9 further comprising coupling a bottom arm to the top arm with a hinge.

13. The method of claim 12 further comprising attaching a second clamping pad to the bottom arm.

14. The method of claim 9 wherein attaching the eyelash strip includes attaching the eyelash strip to the seat and overhanging the seat.

15. A method of operating an eyelash application system comprising:

acquiring a cartridge having a handle, a seat, a clip extending from above the seat and the clip is narrower than the handle, a cartridge mating structure and an eyelash strip adhered to the cartridge with the clip of the cartridge being wider than the eyelash strip;

coupling an applicator to the cartridge by interlocking the cartridge mating structure with an applicator mating structure; and attaching the eyelash strip to a user's eyelash base of a user's eyelid.

16. The method of claim 15 further comprising adhering the eyelash strip to a user's eyelid.

17. The method of claim 15 wherein interlocking the cartridge mating structures with the applicator mating structures includes clicking the applicator onto the cartridge.

18. The method of claim 15 wherein coupling the applicator includes coupling the applicator having a clamping pad with a concave portion.

19. The method of claim 18 wherein coupling the applicator includes coupling the applicator to the cartridge with the clamping pad provided with the applicator mating structure.

* * * * *